US006192192B1

(12) United States Patent
Illy et al.

(10) Patent No.: US 6,192,192 B1
(45) Date of Patent: Feb. 20, 2001

(54) INSTANTANEOUS WATER HEATER

(75) Inventors: Francesco Illy, Lettenrain 16, 6045 Meggen; Matthias Hell, Bienne, both of (CH)

(73) Assignees: Creaholic SA, Bienne; Francesco Illy, Meggan, both of (CH)

( * ) Notice: Under 35 U.S.C. 154(b), the term of this patent shall be extended for 0 days.

(21) Appl. No.: 08/973,795

(22) PCT Filed: Jun. 11, 1996

(86) PCT No.: PCT/CH96/00222

§ 371 Date: Jan. 29, 1998

§ 102(e) Date: Jan. 29, 1998

(87) PCT Pub. No.: WO96/41994

PCT Pub. Date: Dec. 27, 1996

(30) Foreign Application Priority Data

Jun. 13, 1995 (CH) ..... 1736/95

(51) Int. Cl.[7] ..... H05B 3/02

(52) U.S. Cl. ..... 392/480; 392/481; 392/466; 165/85

(58) Field of Search ..... 392/480, 481, 392/488, 489, 472, 471, 478, 441, 442; 99/279, 289 R, 290, 304; 138/33, 118, 119, 28; 165/84, 85, 95

(56) References Cited

U.S. PATENT DOCUMENTS 3,921,708 * 11/1975 Brenner ..... 165/84
4,032,748 * 6/1977 Vischer et al. ..... 392/396
4,184,064 * 1/1980 Williams ..... 392/472
4,667,084 * 5/1987 Regge ..... 392/495
4,778,105 * 10/1988 Cholkeri et al. ..... 236/99 R
5,022,557 * 6/1991 Turner ..... 222/54
5,381,511 * 1/1995 Bahar et al. ..... 392/472
5,575,262 * 11/1996 Rohde ..... 123/467

FOREIGN PATENT DOCUMENTS 176 206 10/1906 (DE) .
606 028 11/1934 (DE) .
44 31 980 3/1995 (DE) .
518 787 12/1992 (EP) .
2 184 928 7/1987 (GB) .

* cited by examiner

*Primary Examiner*—Teresa Walberg
*Assistant Examiner*—Thor Campbell
(74) *Attorney, Agent, or Firm*—Walter C. Farley

(57) ABSTRACT

A continuous flow heater has an elastic, flexible or rigid pipe (10) which is movably mounted and a heat source (6). When a liquid flowing through the pipe is heated in the pipe interior (1), undesired scale tends to be deposited on the interior of the pipe walls. To prevent or remove this deposit, the pipe (10) is moved and/or deformed by an internal overpressure or by application of external forces, causing the deposits to be detached from the pipe inner walls and carried away by the fluid flow. The overall pipe (10) can have an inner pipe (2), inner insulating layers (3–5), a filament (6) and external insulating layers (7–9).

16 Claims, 6 Drawing Sheets

INSTANTANEOUS WATER HEATER

FIELD OF THE INVENTION

This invention relates to a continuous flow heater which is particularly useful for heating water in coffee machines, the heater including a pipe which is moved or deformed to prevent or remove scale formed on the inner walls of the pipe.

BACKGROUND OF THE INVENTION

Devices for heating liquids in pipes or tubes are, e.g., described in the following patents: EP 82 025, GB-2 181 628, U.S. Pat. No. 4,156,127 and U.S. Pat. No. 4,038,519. An important disadvantage of such continuous flow heaters is their contamination by the precipitation of substances dissolved in the liquid. As is known, solubility is highly temperature-dependent. If the temperature of a solution in a pipe is increased, the solubility can be reduced. The dissolved substances are precipitated and are deposited on the pipe inner walls. This leads to pipe narrowing and, in the worst case, to pipe blockage. Thus, e.g., tap water used for coffee preparation contains more or less depositable fractions as a function of the geographical location and these fractions are hereinafter referred to as "scale". When tap water is heated from approximately 20° C. or ambient temperature to approximately 95° C. or boiling temperature, scale is precipitated from the liquid and deposited on the pipe inner walls. Pronounced scaling can be observed from about 60° C.

The pipe scaling problem makes more difficult, or prevents in many cases, the use of continuous flow heaters for heating tap water. Pipes for such continuous flow heaters must be regularly and relatively frequently descaled or replaced, which would give rise to undesired interruptions to operation, as well as labor and material costs. Therefore, e.g., in conventional coffee machines, the water is heated with a solid electrical heating unit at the outlet from a water storage chamber. The hot water first flows through a riser into a boiling chamber, then through the coffee in the boiling chamber and finally through a filter into the coffee jug. For energy saving and time reasons, it is inappropriate to heat the electrical heating unit for preparing a single coffee serving. The solid electrical heating unit of conventional coffee machines has a high heat capacity and a relatively small heating surface, so that high thermal energy must be supplied to it in order to heat it and the heating of the solid unit and the water takes a long time, typically longer than 45 sec.

SUMMARY OF THE INVENTION

An object of the invention is to provide a continuous flow heater device to heat liquids in a pipe to a desired temperature, while avoiding, cancelling out without additional labor and material costs, rendering difficult or slowing down deposit of solid precipitation products on the pipe inner walls. The device can be manufactured using known methods and can be used in known applications, e.g., a coffee machine, without modifying the fundamental sequences of the applications.

Using a continuous flow heater, if solid precipitation products from the heated liquid are deposited on the inner wall of the inventive continuous flow heater, after a short time they are at least partly detached again and carried away by the liquid. Thus, the continuous flow heater according to the invention is either not subject, or is more slowly subject, to scale than known continuous flow heaters and can, e.g., be used in coffee machines.

The detachment of scale such as lime is brought about by movements and/or deformations of the continuous flow heater pipe. It is assumed that over all or part of its length the pipe is mounted in a floating manner. A layer of scale or other solid precipitation products is relatively rigid, brittle and friable. If the continuous flow heater pipe is adequately moved and/or deformed, the layer is at least partly detached from the pipe inner walls and crumbles into small fragments, which are carried away by the liquid.

The movements and/or deformations of the continuous flow heater can fundamentally be ensured by three different embodiments of the pipe. First, the pipe can be elastic and can be radially and/or axially expanded by an overpressure in the pipe interior. Second, the pipe can be flexible and moved by an external force, at at least one of its ends. Third, the pipe can be rigid and moved by an external force, e.g., it can be made to vibrate by a vibrating pump. In these embodiments, distinctions can also be made between static and dynamic operations.

BRIEF DESCRIPTION OF THE DRAWINGS

The continuous flow heater according to the invention is described in greater detail hereinafter with reference to the accompanying drawings, wherein.

DESCRIPTION OF PREFERRED EMBODIMENTS

Figure 1:
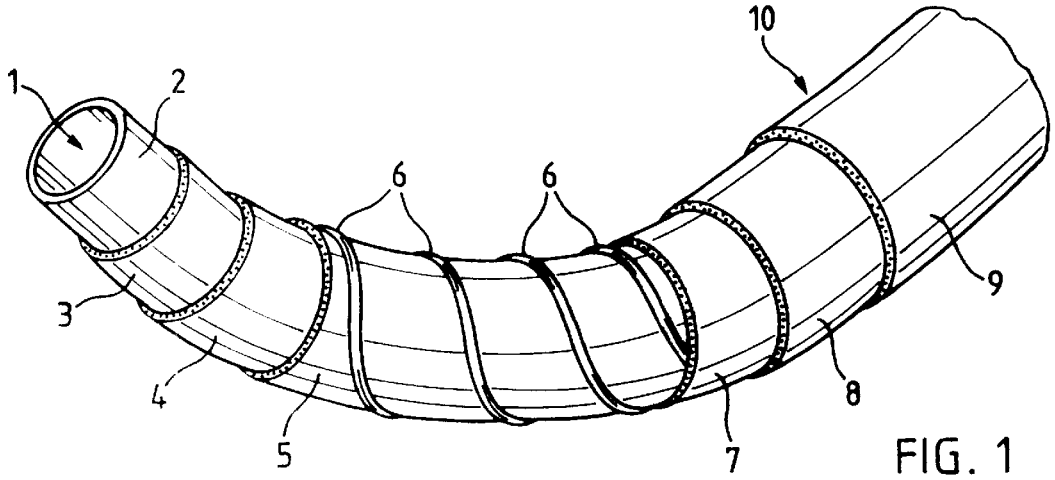
FIG. 1 is a perspective view of a continuous flow heater partially cut away to expose layers thereof.

In the embodiment of FIG. 1, a liquid to be heated flows through the interior 1 of an inner pipe 2 of a continuous flow heater according to the invention. Inner pipe 2 can be made, e.g., from aluminum, some other metal or a heat-resistant plastic. It can be surrounded by one or more layers, the example shown having three, inner insulating layers 3, 4 and 5, which may be needed in order to electrically insulate inner pipe 2 from a filament 6 and to ensure operational safety in accordance with applicable domestic electrical industry standards. Insulating layers 3–5 are made from an electrically insulating, heat-resistant material, e.g. a high temperature-resistant plastic, polyester or glass wool.

In the embodiment shown, a heat source in the form of an electric filament 6 is so externally placed on inner pipe 2 and insulating layers 3–5 that filament 6 can heat the liquid in the inner pipe. Filament 6 is, e.g., spirally wound around the insulating layers and can, e.g., be made from a NiCr alloy. In another embodiment, insulating layers 3–5 can be placed around filament 6 instead of around inner pipe 2. This variation permits closer winding of the filament and, consequently a shorter heating distance and better heat transfer.

Filament 6 shown in FIG. 1 is advantageously so designed that it has a small heat capacity. This characteristic permits a rapid temperature change of filament 6 and consequently facilitates rapid heating of the liquid in the continuous flow heater, so that, e.g., water can be heated by the inventive heater within a few seconds from 20° C. to approximately 95° C. The nature of the heat source is unimportant to the present invention. The liquid could alternatively be heated in the inventive continuous flow heater with means other then an electric filament, e.g., with a gas burner.

Further, external insulating layers 7, 8 and 9 can embrace in the manner of a jacket all the hitherto described components 1 to 6. They ensure thermal insulation of components 1 to 6 from the outside and protect them against mechanical damage, moisture, dirt, electrical contact and other undesired, external influences.

Overall pipe 10 comprising the (in part optional) components 1 to 9, is bendable to at least a certain extent in all directions perpendicular to the pipe axis and/or expandable to at least a certain extent parallel to the pipe axis. These characteristics ensure that under the influence of internal overpressure and/or external forces overall pipe 10 moves and/or is deformed, which leads to detachment of scale from the pipe inner walls. Overall pipe 10 can also be constructed in other forms, not shown here. For example, filament 6 could be differently positioned or completely omitted, or there can be a different number of insulating layers 3–5, 7–9. Throughout the present document the term "pipe" could be replaced by "tube".

FIGS. 2 to 12 schematically show various techniques according to the invention for causing movement and/or deformation of overall pipe 10. The volume on the inlet side of overall pipe 10 is an inlet chamber 11 and the volume on the outlet side of overall pipe 10 is an outlet chamber 12. In a coffee machine or coffee maker, inlet chamber 11 corresponds to the water storage chamber and outlet chamber 12 corresponds to the boiling chamber. Obviously, chambers 11 and 12 need not be large storage containers but instead, e.g., be constructed as tubular extensions of the continuous flow heater overall pipe 10.

Figure 3:
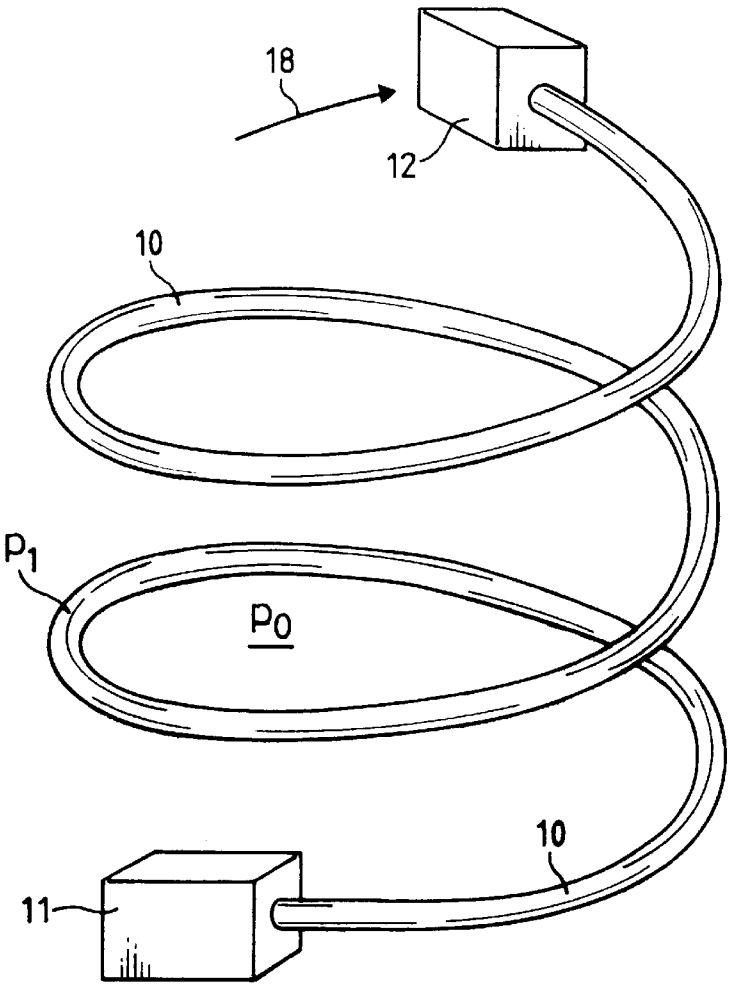
FIGS. 2 and 3 are perspective views of a spiral, flexible pipe showing deformation thereof through a static overpressure in the pipe interior.
Figure 2:
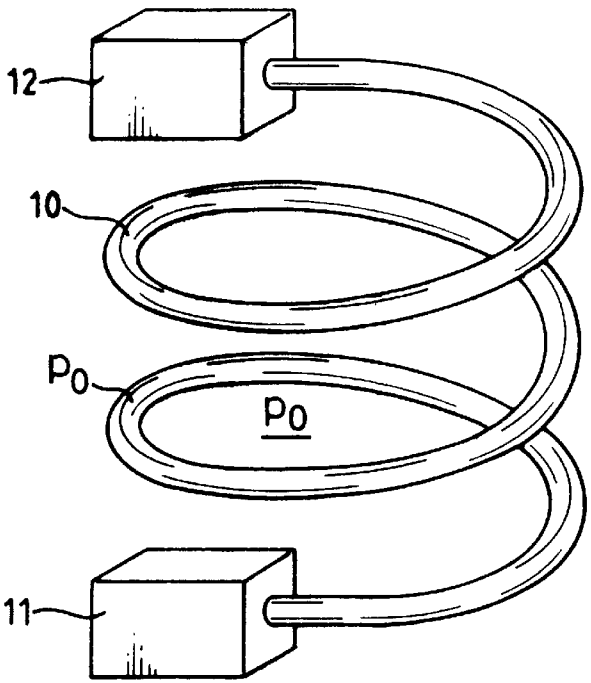

In FIGS. 2 and 3, overall pipe 10 is flexible and is deformed by a static overpressure in the pipe interior. It is, e.g., in the form of an expandable and compressible spiral or helical spring. FIG. 2 shows overall pipe 10 in a rest state in which the pressure in pipe interior 1 is the same as the external pressure $p_0$. FIG. 3 shows overall pipe 10 in an operating state in which the pipe interior contains a liquid at pressure $p_1>p_0$. Under the influence of overpressure $p_1>p_0$, the overall pipe tends to straighten itself or reduce its curvature. If at least one of the two chambers 11 or 12, in the present example outlet chamber 12, is movably suspended, the arrangement follows this tendency. The position change of outlet chamber 12 is indicated by an arrow 18 in FIG. 3. As is apparent from FIG. 3. the radius of curvature of overall pipe 10 increases and the resulting shape change of pipe 10 favors detachment of scale from the pipe inner walls.

Figure 4:
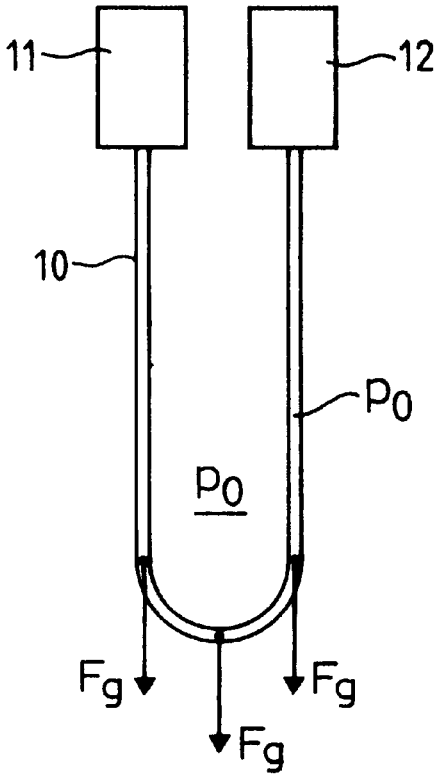
FIGS. 4 and 5 are schematic side elevations of a freely suspended, flexible pipe showing deformation resulting from static overpressure in the pipe interior.
Figure 5:
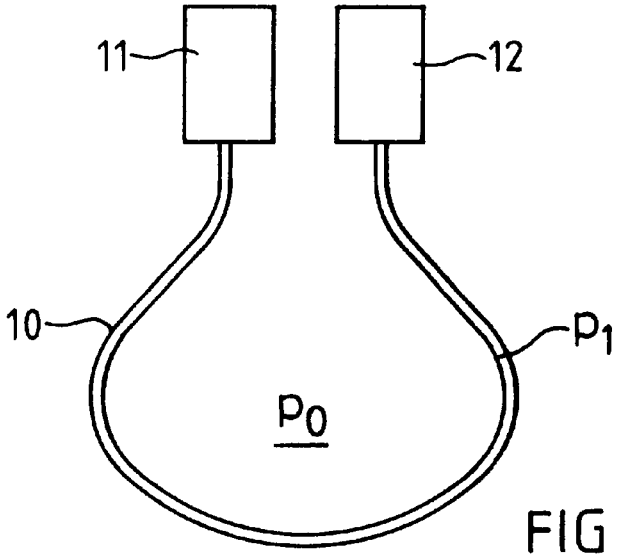

FIGS. 4 and 5 show another inventive arrangement in which a flexible overall pipe 10 is deformed by static overpressure in the pipe interior. In FIG. 4, a freely suspended overall pipe 10 is in a rest state in which the pressure in pipe interior 1 is the same as external pressure $p_0$. If pipe 10 has a negligibly small flexural stiffness, its form or shape in this rest state is largely determined by the forces acting from the outside, e.g., by gravitational force $F_g$. Overall pipe 10 approximately assumes the shape which minimizes its total potential energy. FIG. 5 shows the same pipe 10 in an operating state in which a liquid with the pressure $p_1>p_0$ is in the pipe interior. If the overpressure $p_1-p_0$. is sufficiently high, e.g., a few bars, it can considerably increase the flexural stiffness of overall pipe 10. Overall pipe 10 then roughly assumes the shape which minimizes the curvatures or bends along the entire pipe length. This shape in the operative state can differ significantly from that in the rest state and the resulting shape change aids the detachment of scale from the pipe inner walls.

Figure 6:
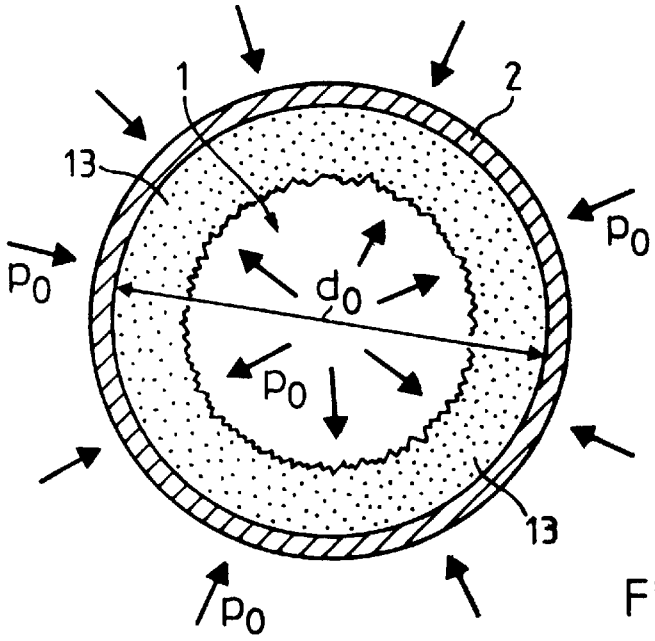
FIGS. 6 and 7 are transverse sectional views of an elastic pipe showing deformation in the radial direction by a static overpressure in the pipe interior.
Figure 7:
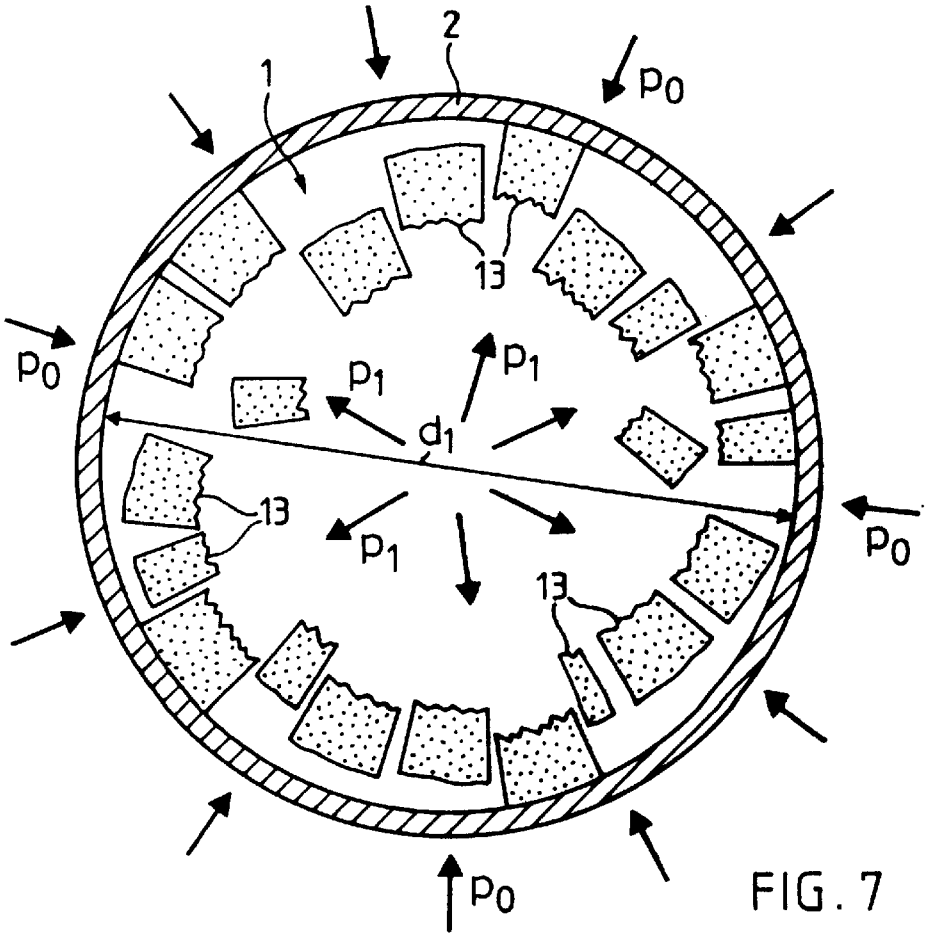

Also, in FIGS. 6 and 7, overall pipe 10 is deformed by a static over-pressure in pipe interior 1. In this case, the pipe is elastic and is radially deformed, so that the inventive descaling action also comes into play in the case of a straight pipe. FIG. 6 shows a cross-section through inner pipe 2 in the rest state, insulating layers 3–5 and 7–9, and filament 6 being not shown for reasons of simplicity. It is assumed that during earlier operation a scale layer 13 has been deposited on the pipe inner walls. The pressure in pipe interior 1 is the same as the external pressure $p_0$ and the pipe diameter is $d_0$. FIG. 7 shows the same pipe in the operating state. A pressure $p_1>p_0$ is built up in the liquid in pipe interior 1. Overpressure $p_1-p_0$ leads to an increase in the inner pipe diameter to $d_1>d_0$. Scale layer 13 is detached from the pipe inner walls and crumbles into small fragments, which can be transported away by the liquid.

Figure 8:
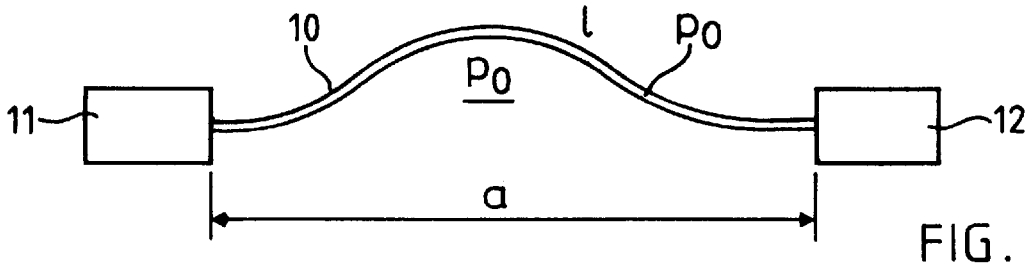
FIGS. 8 and 9 are schematic side elevations of a flexible pipe showing dynamic deformation by a pressure front propagating through the pipe interior.
Figure 9:
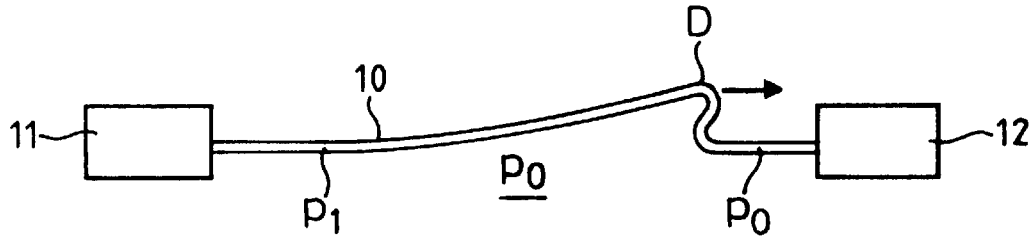

Unlike in the previously discussed, static pipe deformations, FIGS. 8 and 9 illustrate an embodiment of inventive dynamic pipe deformation. FIG. 8 shows a flexible overall pipe 10 in the rest state. Inlet chamber 11, outlet chamber 12 and overall pipe 10 can be arranged in a virtually random manner in which the only condition which has to be fulfilled by the arrangement is that overall pipe length L is greater than the distance a between the inlet and outlet chambers. When a pump located, e.g., in inlet chamber 11 is put into operation, pressure $p_1>p_0$ begins to build up in the pipe interior so that a pressure front starts to pass from inlet chamber 11 to outlet chamber 12. FIG. 9 represents a snapshot shortly after operation is commenced. Prior to the pressure front at position D, overall pipe 10 has a limited flexural stiffness and, during passage of overpressure $p_1-p_0$ behind position D, the overall pipe stiffens and attempts to minimize its curvature. Thus, a wave hump propagates from inlet chamber 11 toward outlet chamber 12. At the location of the wave hump, the pipe is greatly accelerated and deformed, which leads to detachment of scale from the pipe inner walls.

Figure 10:
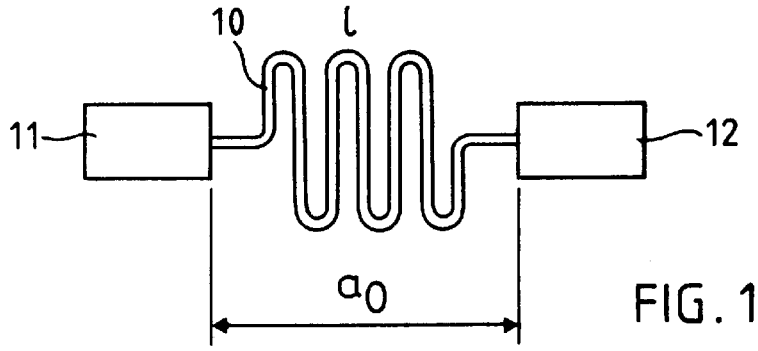
FIGS. 10 and 11 are schematic side elevations of a flexible pipe showing deformation by movement of one pipe end caused by an external force.
Figure 11:
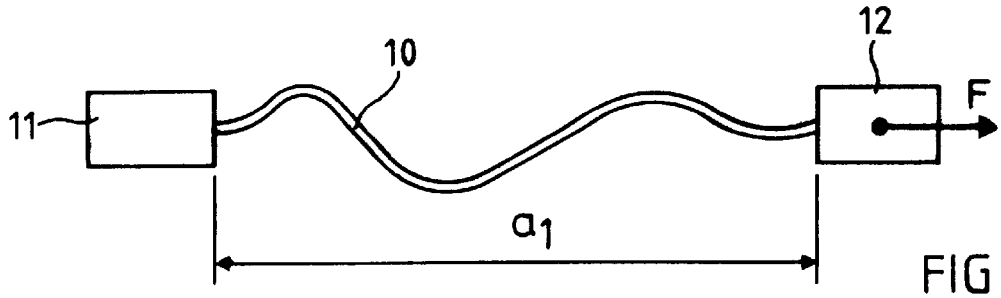

FIGS. 10 and 11 show another embodiment of the invention with a flexible overall pipe. FIG. 10 shows inlet chamber 11, overall pipe 10 and outlet chamber 12 in their normal positions. There are two important prerequisites, namely, that the length L of pipe 10 exceed distance $a_0$ between inlet chamber 11 and outlet chamber 12, and that the inlet or outlet chamber can be removed from the normal position thereof. Otherwise, no special requirements are made on the arrangement. If, as shown in FIG. 11, one of the two chambers, e.g., outlet chamber 12, is moved away from its normal position by an external force F, overall pipe 10 assumes a different shape from that in the normal position. In the example of FIG. 11, force F increases the distance between inlet chamber 11 and outlet chamber 12 from $a_0$ to $a_1>a_0$ so that the curvature along the total pipe length becomes smaller. Pipe scaling is prevented by such movement and/or deformation of overall pipe 10. This embodiment is motivated by the application of the inventive continuous flow heater to a coffee machine where, after each coffee preparation, the coffee in boiling chamber 12 must be replaced. For this purpose, boiling chamber 12 is mounted in a movable part which can be extracted from the coffee machine.

Figure 12:
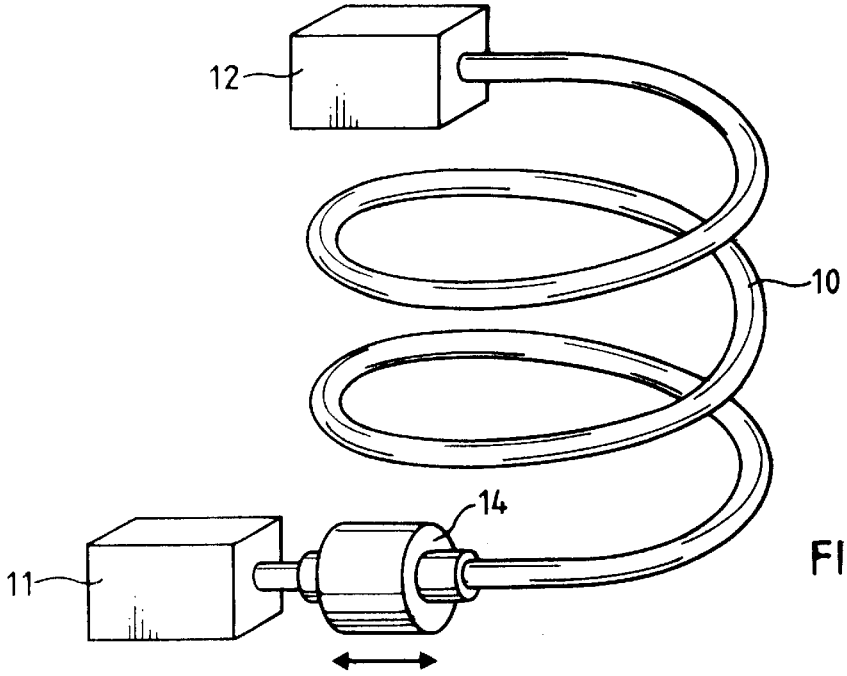
FIG. 12 is a perspective view of a rigid pipe showing deformation due to vibration caused by a pump.

FIG. 12 shows another inventive, dynamic mechanism for preventing pipe scaling. In this embodiment, overall pipe 10 can be rigid as well as flexible and is moved by external forces. Movements of overall pipe 10 are caused, e.g., by a pump 14 in inlet chamber 11. The shape of overall pipe 10 is unimportant in this embodiment. Pump 14 is to be mounted so that it is suspended or movable and during operation must vibrate, e.g., like a diaphragm pump. The pump vibrations, whose direction is indicated by an arrow, are transferred to overall pipe 10. The resulting accelerations to overall pipe 10 prevent pipe scaling or aid scale detachment from the pipe inner walls.

Figure 13:
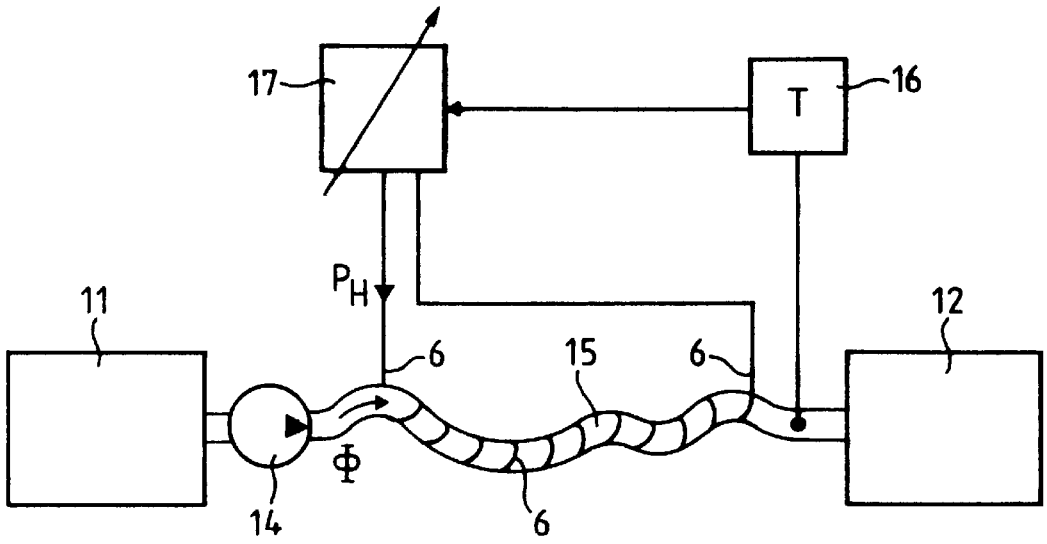
FIGS. 13 and 14 are schematic side elevations of two continuous flow heater constructions with a control loop.
Figure 14:
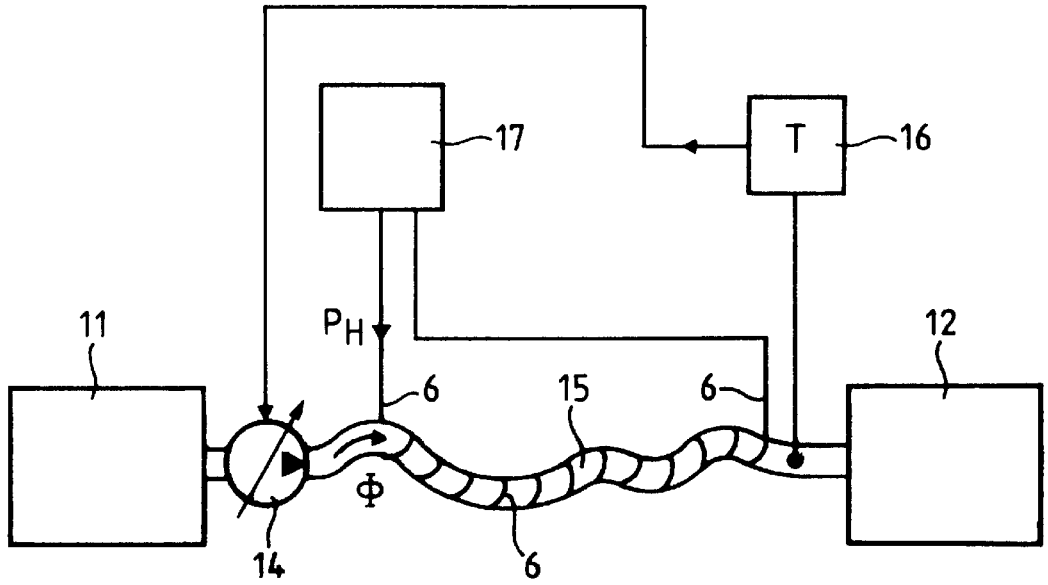

A continuous flow heater according to the invention can be equipped with a control loop, which ensures that the liquid at the pipe outlet has the desired temperature. FIGS. 13 and 14 show two embodiments with a control loop. Pipe 15 is shown in these Figures without details with a filament 6 wound around it. A temperature sensor 16 measures temperature T at the end of pipe 15. In another embodiment, the temperature of the liquid could be measured at the end of pipe 15 or in outlet chamber 12. In the arrangement of FIG. 13, the measured temperature is the controlled variable for the heating capacity $p_H$ produced by a heating current source 17. Pump 14 delivers a time-constant liquid flow $\Phi$ from inlet chamber 11 to outlet chamber 12.

In the arrangement of FIG. 14, the heating capacity $P_H$ is time-constant and the liquid flow $\Phi$ variable, i.e., temperature T is the controlled variable for the pumping capacity. This embodiment may be superior to that of FIG. 13. A timevarying liquid flow $\Phi$ can in fact give rise to turbulence in the liquid and therefore ensure more uniform heating of the liquid and better heat transfer. In a further embodiment, both heating capacity $P_H$ and liquid flow $\Phi$ could be simultaneously regulated.

In summarizing, the continuous flow heater according to the invention comprises a heat source and an overall pipe 10 through which a liquid can flow. Overall pipe 10 is mounted in a floating manner in such a way that it is movable and/or deformable by an internal overpressure $p_1-p_0$. and/or by external forces F. Movement and/or deformation brings about detachment of undesired precipitation products 13 from the pipe inner walls. The invention has resulted from a need for a non-scaling continuous flow heater for water in coffee machines.

What is claimed is:

1. A continuous flow heater for heating a liquid comprising the combination of a pipe through which a liquid can flow, said pipe being elastically deformable;

a heat source for heating liquid in said pipe, whereby deposits from said liquid form on an interior surface of said pipe; and means for elastically deforming said pipe sufficiently to cause said deposits to fragment and separate from said interior surface and to inhibit formation of said deposits.

2. The continuous flow heater of claim 1 wherein said pipe has a central axis and said means for deforming comprises means for physically moving said pipe so that said central axis changes shape.

3. The continuous flow heater of claim 1 wherein said means for deforming comprises a force applied to said pipe to flex said pipe.

4. The continuous flow heater of claim 1 wherein said pipe is in the shape of a compressible and expandible helix.

5. The continuous flow heater of claim 1 wherein said heat source comprises an electrical filament.

6. The continuous flow heater of claim 1 including an outlet chamber connected to receive fluid from said pipe, a temperature sensor adjacent an outlet end of said pipe and a control loop connected to said sensor.

7. The continuous flow heater of claim 6 wherein said temperature senses a fluid temperature (T) at said outlet end of said pipe and said temperature (T) is used by said control loop as a controlled variable of fluid heating of said pipe.

8. The continuous flow heater of claim 6 including a pump for pumping fluid through said pipe and wherein said temperature sensor senses a fluid temperature (T) adjacent said outlet end of said pipe and said control loop responds to said sensed temperature (T) to control flow from said pump.

9. The continuous flow heater of claim 5 wherein said pipe comprises an inner pipe (2), at least one insulating layer (3–5), said filament being around said at least one insulating layer and having a small heat capacity, and at least one external insulating layer (7–9) enclosing said filament.

10. The continuous flow heater of claim 5 wherein said inner pipe (2) comprises a metal.

11. The continuous flow heater of claim 10 wherein said metal comprises aluminum.

12. The continuous flow heater of claim 5 wherein said inner pipe (2) comprises a heat-resistant plastic.

13. The continuous flow heater of claim 5 wherein said insulating layers (3–5, 7–9) comprise at least one electrically insulating and heat-resistant material.

14. The continuous flow heater of claim 5 wherein said filament comprises an alloy of NiCr.

15. A coffee machine having a water storage chamber and a boiling chamber with a pipe according to claim 1 interconnecting said chambers.

16. A coffee machine according to claim 15 wherein said pipe is fixedly attached to said boiling chamber and is moved or deformed when said boiling chamber is opened.

* * * * *